US008383233B2

(12) United States Patent
Palm et al.

(10) Patent No.: US 8,383,233 B2
(45) Date of Patent: Feb. 26, 2013

(54) CEILING TILE BASE MAT

(75) Inventors: Gregory O. Palm, Beavercreek, OH (US); Martin Brown, Gurnee, IL (US); Qing Claire Yu, Libertyville, IL (US); Bangji Cao, Naperville, IL (US)

(73) Assignee: USG Interiors, LLC, Chicago, IL (US)

( * ) Notice: Subject to any disclaimer, the term of this patent is extended or adjusted under 35 U.S.C. 154(b) by 2 days.

(21) Appl. No.: 12/975,501

(22) Filed: Dec. 22, 2010

(65) Prior Publication Data

US 2012/0164422 A1 Jun. 28, 2012

(51) Int. Cl.
*B32B 7/02* (2006.01)

(52) U.S. Cl. ..... 428/220; 428/212; 106/711; 106/814; 106/673

(58) Field of Classification Search ..... 428/212, 428/220; 106/711, 814, 673
See application file for complete search history.

(56) References Cited

U.S. PATENT DOCUMENTS

| | | | | |
|---|---|---|---|---|
| 3,379,609 | A * | 4/1968 | Roberts | 162/181.6 |
| 4,062,721 | A | 12/1977 | Guyer et al. | |
| 4,911,788 | A | 3/1990 | Pittman et al. | |
| 5,013,405 | A | 5/1991 | Izard | |
| 5,910,082 | A | 6/1999 | Bender et al. | |
| 5,964,934 | A * | 10/1999 | Englert | 106/287.1 |
| 6,057,254 | A | 5/2000 | Bender et al. | |
| 6,061,985 | A | 5/2000 | Kraus et al. | |
| 2004/0251573 | A1 | 12/2004 | Schmid | |
| 2007/0186587 | A1 | 8/2007 | Dennert | |
| 2009/0173464 | A1 * | 7/2009 | Baig | 162/164.1 |

FOREIGN PATENT DOCUMENTS

| | | | |
|---|---|---|---|
| CA | 2348326 | A1 | 5/2001 |
| EP | 2130985 | A2 | 12/2009 |

OTHER PUBLICATIONS

International Search Report and Written Opinion dated Apr. 5, 2012 of corresponding International Patent Application No. PCT/US2011/064140, filed Dec. 9, 2011.

* cited by examiner

*Primary Examiner* — Maria Veronica Ewald
*Assistant Examiner* — Lawrence Ferguson
(74) *Attorney, Agent, or Firm* — Pearne & Gordon LLP

(57) ABSTRACT

A water felted base mat for a suspended ceiling tile comprising on a weight basis about ½ mineral wool, starch binder, limited to about ⅛, newsprint, limited to about ⅛, and about ¼ expanded glass beads.

2 Claims, No Drawings

CEILING TILE BASE MAT

The invention relates to materials for building construction and, in particular, to ceiling panel compositions.

PRIOR ART

There is a growing awareness of the environmental impact of the manufacture of building materials and products. One potential way of reducing adverse environmental effects and establishing sustainability is by recycling materials. Such recycled materials are sometimes broadly classified as post consumer recycled material and post industrial recycled material. Post consumer recycled material is especially encouraged by such organizations as LEED.

Ceiling tile used in suspended ceilings should have certain performance characteristics that include sound absorbing capacity, relatively low density, fire-resistance, and sag-resistance. Besides meeting these criteria, the raw materials need to be relatively inexpensive to procure and easy to process. These characteristics can be difficult to achieve even with a composite of material. Moreover, the universe of available recycled materials that can contribute one or more of these desirable characteristics, is compatible with other viable materials, is available at a practical cost and does not introduce undesirable characteristics is limited. It is important to find a high recycled content formulation that achieves these essential characteristics, but also is compatible with existing manufacturing equipment and processes.

SUMMARY OF THE INVENTION

The invention involves the discovery of a successful high recycled content formulation for ceiling tile base mat. The formulation is suitable for use in existing water felted processes and offers the potential of increasing the energy and material usage efficiency of such processes. It has been discovered that expanded glass beads can be successfully used as a filler in a wet felted formulation. This filler material, used with selected components in appropriate proportions, achieves satisfactory sound absorption as well as suitable mechanical properties including wet and dry strength, hardness, stiffness, and sag resistance. These characteristics, moreover, can be achieved in a base mat having the relatively low density of about 15 lbs./cubic ft. Additionally, these beads in proper proportions with other materials have the potential to improve energy efficiency by reducing water process requirements and water load in the wet mat from what has been experienced in prior art mat formulations. Advantageously, the expanded glass beads can be used with materials commonly used in the industry so that supply channels, raw material storage and processing issues can be simplified.

DESCRIPTION OF THE PREFERRED EMBODIMENT

Ceiling tiles or panels are commonly used to construct a suspended ceiling. The tiles are laid in a rectangular grid and typically have nominal face dimensions of 2'×2' and 2'×4', or metric equivalents of these dimensions. A generally conventional wet felting process, known in the art, is used to produce a tile base mat in accordance with the present invention. In such a process, the base mat constituents are mixed in a water slurry which is deposited on a moving wire screen to form a layer of the mat material at some specified thickness. The material layer gravity drains and can be subsequently subjected to a vacuum to draw off additional water content. Such vacuuming and optional pressing steps may be repeated. After this mechanical dewatering, the material can be conveyed to a dryer where remaining water is evaporated out of the mat and a binder in the mat formulation is caused to set or cure.

The invention involves a discovery of a combination of materials and their relative proportions that produce a ceiling tile base mat with a high recycled material content, improved processing characteristics in addition to acceptable material properties and performance characteristics. It has been found that expanded glass beads from post consumer recycled glass can be successfully used as a filler with other components to produce a water felted base mat for use in a ceiling tile. A suitable source of expanded glass beads is Poraver North America Ltd. Experimentation has shown that expanded glass beads of a nominal size of about 0.1 to about 0.3 mm and a bulk density of about 25 lbs./ft$^3$ is particularly useful with the products disclosed herein. Where the consistency of a slurry being felted is relatively high, larger beads, for example of a size of about 1 to 2 mm with a density of about 14 to 15 lbs./ft$^3$ can be used without the risk of the beads floating out of the slurry. Still further, the experimentation has revealed that the following constituents in the respective proportions on a weight basis can yield satisfactory results.

| | Percentage by Weight | | |
|---|---|---|---|
| | Useable Range % | Preferred Range | Example of Specific Formulation |
| mineral wool | 8-91 | 30-70 | 57 |
| binder (corn starch) | 1-14 | 7-12 | 9 |
| cellulose fiber (newsprint) | 1-20 | 3-12 | 6 |
| glass beads | 1-60 | 5-30 | 27 |

While the above formulation at the right is an example of a preferred mixture, it will be understood that variation in the proportions can be made without a significant loss of performance. Cornstarch is most commonly used as a binder; where latex is used as a binder its content is generally lower in percentage, such as about 3% or more. As a general guide, the proportions of the constituents should fall within the ranges specified in the table above. The table suggests, in broad terms, a formulation for a base mat, in accordance with the invention, may comprise, by weight, about ½ mineral wool, less than about ⅛ starch binder, less than about ⅛ newsprint, and about ¼ expanded glass beads. A practical base mat, for example, can have a nominal caliper of about ⅞" and a density of 15 lbs./ft$^3$ or less.

Several unexpected advantages have been found in the use of expanded glass beads over conventionally used expanded perlite in the manufacture of a ceiling tile base mat. These include the ability to mix the components at a higher consistency, i.e. ratio of weight of solid components to the weight of water in a slurry used to form the base mat than is normally used in prior art formulations using expanded perlite as a filler. This high consistency reduces the amount of process water used to make the disclosed base mat. Further, the water load, i.e. the water content mechanically retained in the mat preform after vacuum and pressing operations is lower than that in typical formulations using expanded perlite. This reduced water load allows the mat to be dried with less energy and with increased line speed.

The combination of expanded glass beads and newsprint fiber has been found to improve the wet strength of the constituents. This wet strength can make the manufacturing process more tolerant of variations in handling forces, thereby reducing scrap and time to make the product. Despite being many times heavier than the frequently used expanded perlite filler in wet felted base mat, the expanded glass beads can produce a low density product that exhibits good acoustic properties. These relative densities make it counter intuitive that a viable low density ceiling tile base mat could be formed with expanded glass beads. However, the formulation of the referenced constituents can yield a base mat with a density of about 15 lbs./cubic foot with satisfactory characteristics. As a general rule, the newsprint content should be limited to about 6%; it has been found that greater proportions of newsprint will tend to degrade NRC (noise reduction coefficient). Expanded glass bead content in normal circumstances should be limited to about 30% so as to avoid excessive friability in the base mat.

The water felted glass bead filled base mat product described herein after being dried is typically top coated with a paint-like coating to improve its light reflectance and appearance as a finished panel or tile as is customary in the industry. Before top coating, the base mat can be ground to produce a relatively smooth surface. Additionally, the face of the base mat can be perforated or fissured to improve its sound absorption performance.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A water felted base mat for a suspended ceiling tile comprising on a weight basis about ½ mineral wool, starch binder, limited to about ⅛, newsprint, limited to about ⅛, and about ¼ expanded glass beads from post-consumer recycled glass, the glass beads having a density of 25 lbs./$ft^3$.

2. A water felted base mat as set forth in claim 1, wherein the mat has a caliper of about ⅞".

* * * * *